United States Patent [19]

Masuda

[11] 4,393,283

[45] Jul. 12, 1983

[54] JACK WITH PLUG ACTUATED SLIDE SWITCH

[75] Inventor: Toru Masuda, Higashi-Osaka, Japan

[73] Assignee: Hosiden Electronics Co., Ltd., Osaka, Japan

[21] Appl. No.: 271,945

[22] Filed: Jun. 9, 1981

[30] Foreign Application Priority Data

Apr. 10, 1980 [JP] Japan ..... 55-48956[U]

[51] Int. Cl.[3] ..... H01A 33/30; H01H 9/02

[52] U.S. Cl. ..... 200/51.09; 200/307; 200/51.1; 200/254

[58] Field of Search ..... 200/51.09, 51.10, 51.05, 200/51.06, 16 E, 16 F, 18, 50 B, 254, 307

[56] References Cited

U.S. PATENT DOCUMENTS

| | | | |
|---|---|---|---|
| 3,045,078 | 7/1962 | Frantz et al. | 200/51.1 |
| 3,812,310 | 5/1974 | Gasparaitis et al. | 200/51.1 |
| 3,909,566 | 9/1975 | Morrison et al. | 200/51.1 |
| 3,949,180 | 4/1976 | Ojima et al. | 200/51.1 |
| 4,029,924 | 6/1977 | Frank et al. | 200/307 |
| 4,064,381 | 12/1977 | Mullen et al. | 200/307 |
| 4,324,958 | 4/1982 | Valleau | 200/16 F |

*Primary Examiner*—Stephen Marcus
*Assistant Examiner*—Ernest G. Cusick
*Attorney, Agent, or Firm*—Steele, Gould & Fried

[57] ABSTRACT

A jack for receiving a plug includes a detachable slide switch operated by a contact strip which engages the plug. Additional slide switches may be nested below the first slide switch, the entire stack being operated by the contact strip as the plug is inserted in the jack.

5 Claims, 3 Drawing Figures

JACK WITH PLUG ACTUATED SLIDE SWITCH

BACKGROUND OF THE INVENTION

The present invention relates to a jack capable of changing the position a switch upon the fitting or removing of a plug into or from the jack.

There are well known jacks of this type in which a movable contact strip is housed in a box-shaped jack case with its one end fixed to the jack case while its other free end is positioned facing the plug fitting opening of jack case, a slide switch is attached onto the lower face of jack case in such a way that the operating lever of slide switch is inserted into the jack case through the lower face thereof, and when the free end of movable contact strip is urged to the side way by the plug fitted into the plug fitting opening of jack case, the operating lever of slide switch is pressed by the urged free end of movable contact strip to thereby change over the slide switch. However, these jacks each including the jack case mounted on the slide switch become too bulky to thereby make it difficult to be incorporated into slim electronic appliances such as micro-cassette tape recorder and small-sized radio. In addition, it has been requested these days that jacks employed in slim electronic appliances be ultra-small-sized together with plugs fitted into jacks. When jacks are ultra-small-sized like this to meet such need, the displaced amount of movable contact strip pressed and displaced by the plug becomes extremely small. Therefore, in the case of conventional jacks in which the free end of movable contact strip is pressed as described above by the plug and the operating lever of slide switch is further pressed by the pressed free end of movable contact strip, the changeover of slide switch is liable to become incomplete.

There are also well known jacks of this type in which the different changeover switch is incorporated integral into the jack case. However, the number of changeover circuits for changeover switches incorporated has a limit and even if a plurality of changeover switches are incorporated into the jack case, the jack case itself becomes bulky causing a problem in being incorporated into appliances. In addition, in the case where all of changeover circuits are not necessarily used responding to the purpose of use, the user must use the jack larger than necessity requests.

On the other hand, the jack maker must make various kinds of jack such as having no changeover switch and having changeover switches which are different in the number of changeover circuits to meet needs of user.

SUMMARY OF THE INVENTION

An object of the present invention is to provide a jack allowing a changeover switch to be fitted into the back face of a jack case to keep the jack itself slim and thus allowing the jack formed to be incorporated into extremely slim electronic appliances of these days.

Another object of the present invention is to provide a jack allowing a changeover switch to be urged enlarging the displaced amount of a movable contact strip or using the maximum portion of displaced amount even if the displaced amount of movable contact strip is extremely small and thus allowing the changeover operation to be achieved with certainty even if a plug having a particularly small diameter is used.

A further object of the present invention is to provide a jack allowing a switch case to be detachably fitted into the back face of jack case and allowing the small-sized jack itself to be employed by the user when the switch case is detached from the jack case.

A still further object of the present invention is to provide a jack allowing an optional number of switches, which are detachable from one another, to be fitted into the back face of jack case successively and allowing the number of changeover circuits for changeover switches to be freely increased or decreased responding to the purpose of use.

DETAILED DESCRIPTION OF THE PREFERRED EMBODIMENTS

Figure 1:
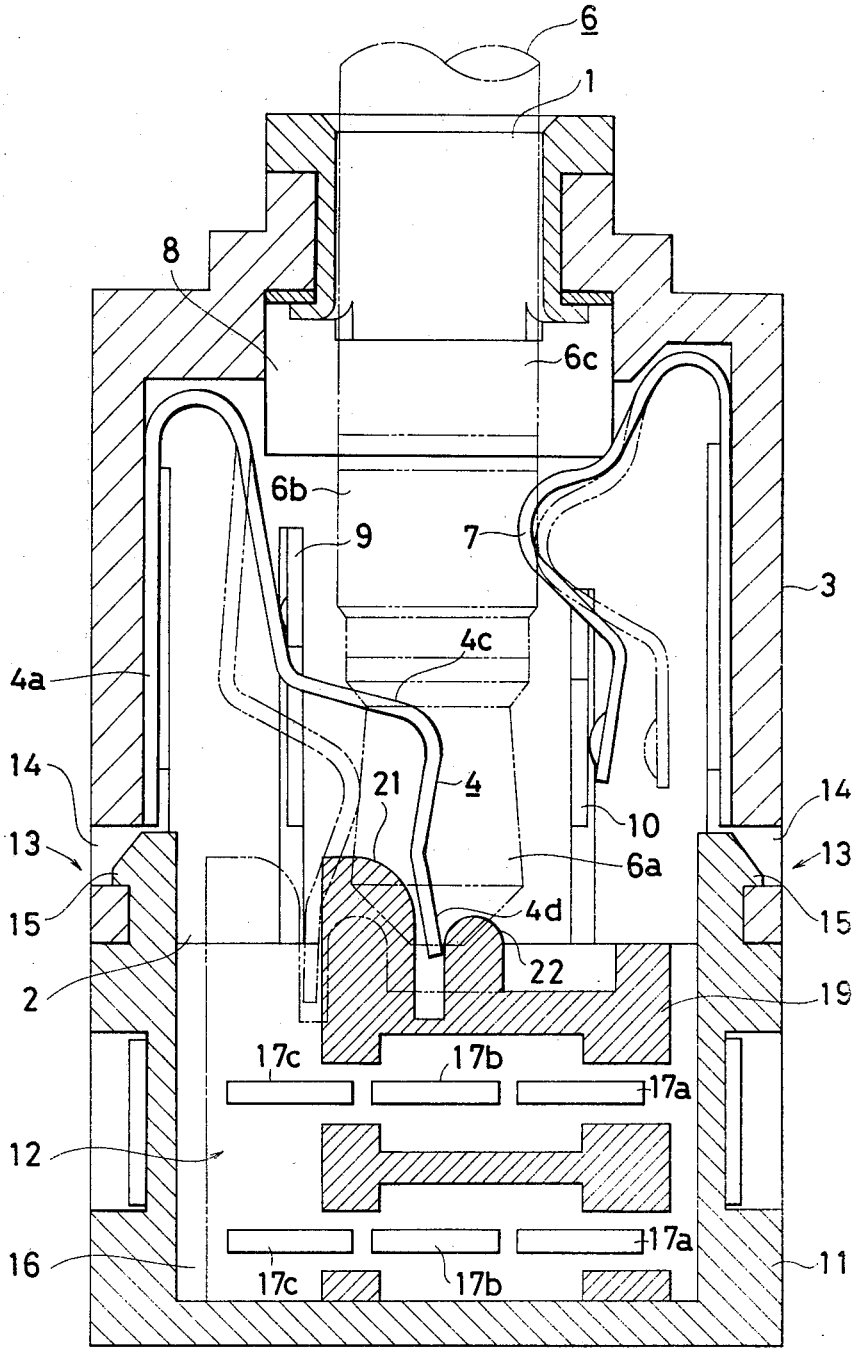
FIG. 1 is a longitudinally cross sectioned view showing an embodiment of the present invention.
Figure 2:
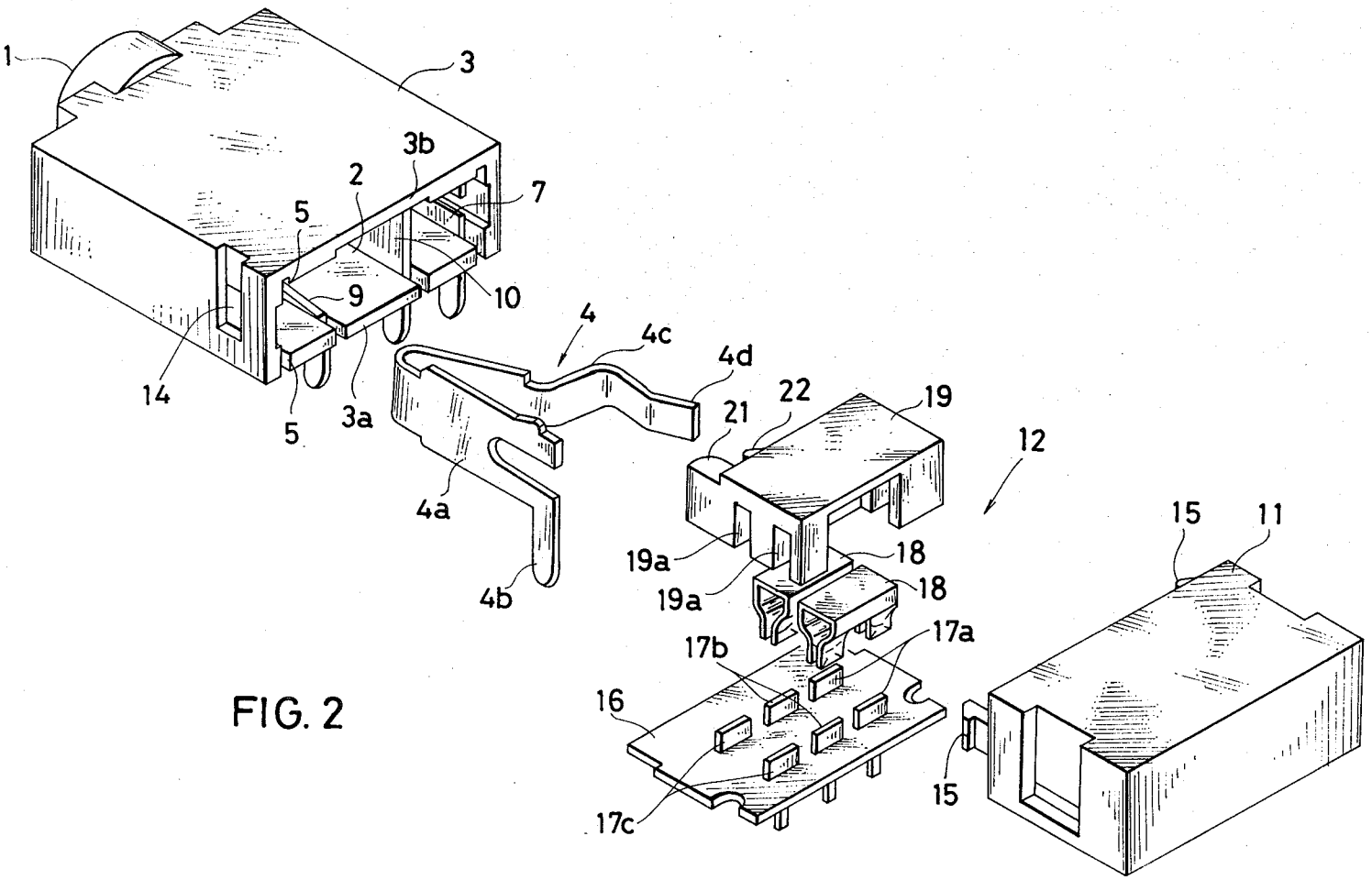
FIG. 2 is a perspective view showing the embodiment disassembled.

Referring to FIGS. 1 and 2, a movable contact strip 4 is housed in a box-shaped jack case 3 which has a plug fitting opening 1 on the front side thereof and an opening 2 on the back side thereof. The movable contact strip 4 is made of good conductive metal plate and tongue-shaped having an attaching portion 4*a* at the fixed portion thereof and a contact terminal 4*b* at the back end of attaching portion 4*a*. The movable contact strip 4 is pressed into the jack case 3 from the back side thereof in such a way that the attaching portion 4*a* is fitted into grooves 5 and 5 which are formed opposite to each other in inner surfaces of upper and lower faces 3*b* and 3*a* of jack case 3. The movable contact strip 4 thus attached into the jack case 3 has the center portion 4*c* thereof facing the plug fitting opening 1 of jack case 3 and the free end 4*d* thereof extending through the opening 2 of jack case 3. When a plug 6 is fitted into the plug fitting opening 1, the center portion 4*c* of movable contact strip 4 is resiliently contacted with an end electrode 6*a* of plug 6. Numeral 7 represents a movable contact strip resiliently contacted with an intermediate electrode 6*b* of plug 6, 8 a movable contact strip resiliently contacted with a base electrode 6*c* of plug 6, 9 a fixed contact strip contacted with the movable contact strip 4 when the plug 6 is not fitted into the plug fitting opening 1 of jack case 3, and 10 a fixed contact strip contacted with the movable contact strip 7 when the plug is not fitted.

A switch case 11 is connected into the opening of back face of jack case 3 and houses a switching means or slide switch 12 therein. The switch case 11 is box-shaped and opened on front and bottom sides thereof. The switch case 11 is detachably attached to the jack case 3 by means of engaging means or concaved and convexed engaging portions 13, which comprise engaging holes 14 and 14 formed in both side walls of jack case 3 and hook-shaped engaging projections 15 and 15 projected from both sides of front face of switch case 11. When the switch case 11 is pressed into the jack case 3 from the back side thereof, engaging projections 15 and 15 are resiliently engaged with engaging holes 14 and 14. The slide switch 12 comprises an insulating base plate 16 covering the bottom opening of switch case 11, a plurality of terminals 17*a*, 17*b*, 17*c*, . . . arranged in rows on the insulating base plate 16, and a clip holder 19 having clips 18 and 18 in grooves 19*a* and 19*a* formed in the bottom face thereof and being arranged freely slidable along rows of terminals 17*a*, 17*b* and 17*c*, said clips 18 and 18 being intended to contact terminals 17*a*, 17*b* and 17*c*. A pair of connecting projections 21 and 22 are projected from the front face of clip holder 19, and the free end portion 4*d* of movable contact strip 4 is held between these connecting projections 21 and 22.

According to the jack having such arrangement as described above, the center portion 4*c* of movable contact strip 4 is held facing the plug fitting opening 1 as shown by a solid line in FIG. 1 when the plug 6 is not fitted into the plug fitting opening 1. And the clip holder 19 of slide switch 12 is urged by the free end portion 4*d* of movable contact strip 4 to the right side position to thereby bring first and second terminals 17*a* and 17*b* into connection through clips 18 and 18 held by the clip holder 19. When the plug 6 is fitted into the plug fitting opening 1, the center portion 4*c* of movable contact strip 4 is pressed by the plug 6 to the left side in FIG. 1. Therefore, the free end portion 4*d* of movable contact strip 4 is similarly displaced to the left side to press the clip holder 19 of slide switch 12 to the left side, too. As the result, the clip holder 19 is slide to the left side position shown by a two-dotted line in FIG. 1 to thereby render second and third terminals 17*b* and 17*c* contacted through clips 18 and 18 held by the clip holder 19. The slide switch 12 can be changed over like this by the fitting or detaching of plug 6 into or from the plug fitting opening 1.

According to the embodiment of the present invention wherein the fixed portion or attaching portion 4*a* of movable contact strip 4 is supported on a side of jack case 3 with the center portion 4*c* thereof held facing the plug fitting opening 1 and the slide switch 12 is changed over by the free end portion 4*d* of movable contact strip 4, the switch case 11 housing the slide switch 12 can be connected into the jack case 3 from the back side thereof to thereby keep the height of jack unchanged. Therefore, the jack thus formed can be easily incorporated into slim electronic appliances which have become very popular these days.

The center portion 4*c* of movable contact strip 4 is adapted for contact with the plug 6 and the slide switch 12 is changed over by the free end portion 4*d* extending backwards from the contact portion 4*c*, so that the displaced amount of movable contact strip 4 due to the plug 6 can be transmitted in enlarged scale to the slide switch 12, thus allowing the changeover operation of slide switch 12 to be achieved with certainty even if the case of ultra-small-sized jack into which the plug 6 having a small diameter is fitted.

The switch case 11 housing the slide switch 12 therein is made separately from the jack case 3 and detachably connected to the jack case by engaging means, so that the switch case 11 can be detached from the jack case 3 when the slide switch 12 is not needed, thus allowing the jack to be used according to the purpose of use. Namely, the user can always use the jack in the smallest size according to the purpose of use.

The slide switch is returned from the position shown by two-dotted line to the position shown by the solid line by the resiliency of movable contact strip. However, the present invention is not limited to this, but a spring may be attached to the slide switch so as to return the slide switch from the position shown by the two-dotted line to the position shown by the solid line.

Figure 3:
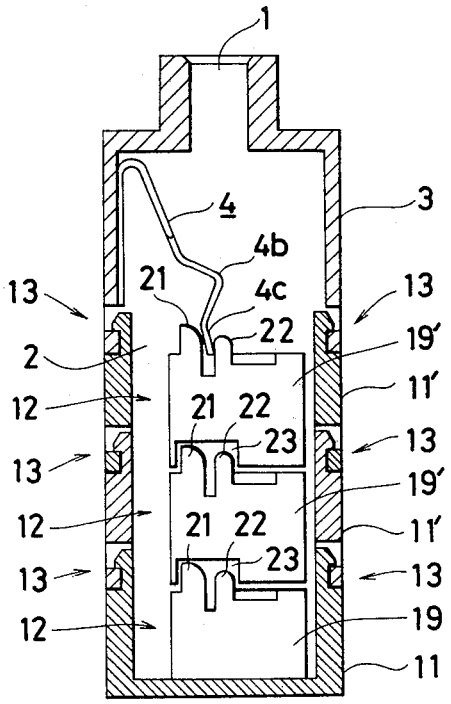
FIG. 3 is a longitudinally cross sectioned view showing another embodiment of the present invention.

Though the embodiment of the present invention has been described referring to the case where one single slide switch is employed, the slide switch may be plural. As shown in FIG. 3, switch cases 11', 11' and 11 are made every slide switch 12 and connected, as described above, with one another by means of concaved and convexed engaging portions 13 to form a desired number of slide switches. In this case, a recess 23 is formed in the back face of clip holder 19' of each of slide switches 12 and connecting projections 21 and 22 of a next clip holder 19' or 19 are fitted into the recess 23 of previous clip holder 19', thus alowing all of clip holders 19', 19' and 19 to be detachably connected with one another. An optional number of slide switches 12, which are detachably connected with one another, can be detachably fitted into the jack case 3 from the back side thereof, so that the number of changeover circuits for changeover switches can be freely increased or decreased according to the purpose of use and the user can incorporate into appliances the jack with which only a necessary number of slide switches are connected to meet the purpose of his use.

The jack maker may only produce a great number of slide switches 12 which are of same construction to meet various needs of users, thus making it possible to enjoy the merit of mass production and also to easily prepare a production plan in the future.

Even when a large number of switch cases 11' are connected, these switch cases 11' connected with one another are fitted integral into the jack case 3 from the back side thereof, thus keeping the height of jack same and making the jack extremely suitable for incorporation into slim appliances.

The jack case 3 can be detached from the switch case 11' and switch cases 11' can also be detached from one another, so that a member such as metal plate may be interposed between them to effect electrostatic shielding, if necessary.

The slide switch 12 is not limited to the one employed in embodiments of the present invention but may be a contact switch or the like.

What is claimed is:

1. A jack, comprising:

a jack case having a first opening for receiving a plug and a second opening for receiving a switch case;

a contact strip attached to an inner surface of the jack case, the contact strip being resiliently urged into a first position engageable by the plug on insertion thereof, the plug engaging and moving the contact strip to a second position, the contact strip having a free end portion, carried thereupon, disposed adjacent the second opening in the jack case; and, a switch case, having a self-contained switch mechanism therein, removably fitted into the second opening, the switch mechanism having electrical contacts and a movable member adapted to open and close the contacts, the movable member being engaged by the free end portion of the contact strip, opening and closing the contacts in response to insertion and removal of the plug.

2. A jack according to claim 1, further comprising a plurality of switch cases, each detachably connected to one another in a stack, each of the switch cases having a self-contained switch mechanism including a movable member and contacts mounted therein, the movable member of each of the plurality of switch cases having interfitting structure on opposite sides thereof, whereby each switch case can nest into at least one adjacent switch case.

3. A jack according to claim 1, wherein the plug and the first opening define an insertion axis, the contact strip and the movable member being movable transversely to the axis.

4. A jack according to claim 1, wherein the movable member of the switch includes an extending engaging means adapted to receive the free end portion of the contact strip.

5. A jack according to claim 1 wherein the switch case is detachably connected with the jack case by means of engaging means.

* * * * *